US011429041B1

(12) United States Patent
Hayashi et al.

(10) Patent No.: US 11,429,041 B1
(45) Date of Patent: Aug. 30, 2022

(54) CONDUCTIVE ROLL, TRANSFER DEVICE, PROCESS CARTRIDGE, AND IMAGE FORMING APPARATUS

(71) Applicant: FUJIFILM Business Innovation Corp., Tokyo (JP)

(72) Inventors: Shogo Hayashi, Kanagawa (JP); Minoru Rokutan, Kanagawa (JP); Takuro Hoshio, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/498,760

(22) Filed: Oct. 12, 2021

(30) Foreign Application Priority Data

Jun. 30, 2021 (JP) ..... JP2021-109502

(51) Int. Cl.

| | |
|---|---|
| ***G03G 15/16*** | (2006.01) |
| ***G03G 15/01*** | (2006.01) |
| ***G03G 15/02*** | (2006.01) |
| ***G03G 15/08*** | (2006.01) |

(52) U.S. Cl.
CPC ..... *G03G 15/1685* (2013.01); *G03G 15/0131* (2013.01); *G03G 15/162* (2013.01); *G03G 15/0233* (2013.01); *G03G 15/0818* (2013.01); *G03G 2215/0861* (2013.01); *G03G 2215/1614* (2013.01)

(58) Field of Classification Search
CPC ..... G03G 15/0131; G03G 15/162; G03G 15/1685; G03G 15/0233; G03G 15/0818; G03G 2215/1614; G03G 2215/0861
See application file for complete search history.

(56) References Cited

U.S. PATENT DOCUMENTS

| | | | | |
|---|---|---|---|---|
| 2001/0024582 | A1* | 9/2001 | Hwang | G03G 15/2053 432/60 |
| 2006/0280518 | A1* | 12/2006 | Kamoshida | G03G 15/025 399/168 |
| 2011/0236691 | A1* | 9/2011 | Fukumoto | B29C 65/66 428/421 |

FOREIGN PATENT DOCUMENTS

| | | |
|---|---|---|
| JP | 2009244824 | 10/2009 |
| JP | 2014071147 | 4/2014 |
| JP | 2014126602 | 7/2014 |

* cited by examiner

*Primary Examiner* — Joseph S Wong
(74) *Attorney, Agent, or Firm* — JCIPRNET

(57) ABSTRACT

A conductive roll includes a support member, an elastic layer disposed on an outer peripheral surface of the support member, and a top layer disposed on an outer peripheral surface of the elastic layer. In a case where a pushing amount of a metal roll into the conductive roll is 1.7%, the metal roll having an outer diameter identical to an outer diameter of the conductive roll, a shrinkage rate of a surface of the conductive roll with respect to the outer diameter of the conductive roll is equal to or more than 5%.

20 Claims, 4 Drawing Sheets

CONDUCTIVE ROLL, TRANSFER DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2021-109502 filed Jun. 30, 2021.

BACKGROUND

(i) Technical Field

The present invention relates to a conductive roll, a transfer device, a process cartridge, and an image forming apparatus.

(ii) Related Art

JP2014-126602A proposed the followings. "A transfer roll that includes a conductive support, a conductive elastic layer provided on the conductive support, and a conductive resin layer configured to be provided on the conductive elastic layer and to contain a resin material and a conductive agent. The conductive resin layer has a first region forming the outermost surface and a second region which is provided between the first region and the conductive elastic layer to be in contact with the conductive elastic layer and has a surface resistivity lower than a surface resistivity of the first region. A nip is formed to have an inclination of a bite amount in an axial direction. In a case where a recording medium is inserted into the nip, a difference between a transport amount at a portion at which the bite amount is 0.5 mm and a transport amount at a portion at which the bite amount is 1.3 mm is 1.5 mm or more/400 mm.

JP2014-071147A proposed the followings. "A toner supply roll for electrophotographic equipment is a toner supply roll having a shaft body and a roll-like polyurethane foam formed on an outer periphery of the shaft body. The polyurethane foam has a storage elastic modulus which is equal to or more than of 100 kPa and includes a surface cell and a central cell that communicate with each other. An average cell diameter of the central cell is 200 to 1000 μm. A relation between a curved-surface pressing nip width and a flat-surface pressing nip width satisfies the following expression (1). The curved-surface pressing nip width is a nip width when being pressed on a curved surface. The flat-surface pressing nip width is a nip width when being pressed on a flat surface.

$$\text{Curved-surface pressing nip width} \ (\text{flat-surface pressing nip width} \times 0.65) \quad (1)$$

SUMMARY

Aspects of non-limiting embodiments of the present disclosure relate to a conductive roll, a transfer device, a process cartridge, and an image forming apparatus that easily increase a parallelism of an image transferred to a recording medium in comparison to a case where, in a conductive roll including a support member, an elastic layer disposed on an outer peripheral surface of the support member, and a top layer disposed on an outer peripheral surface of the elastic layer, in a case where a pushing amount of a metal roll into the conductive roll is 1.7%, the metal roll having an same outer diameter identical to an outer diameter of the conductive roll, a shrinkage rate of a surface of the conductive roll with respect to the outer diameter of the conductive roll is less than 5%.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided conductive roll including a support member, an elastic layer disposed on an outer peripheral surface of the support member, and a top layer disposed on an outer peripheral surface of the elastic layer. In a case where a pushing amount of a metal roll into the conductive roll is 1.7%, the metal roll having an outer diameter identical to an outer diameter of the conductive roll, a shrinkage rate of a surface of the conductive roll with respect to the outer diameter of the conductive roll is equal to or more than 5%.

BRIEF DESCRIPTION OF THE DRAWINGS

Exemplary embodiment(s) of the present invention will be described in detail based on the following figures, wherein.

DETAILED DESCRIPTION

Figure 1A:
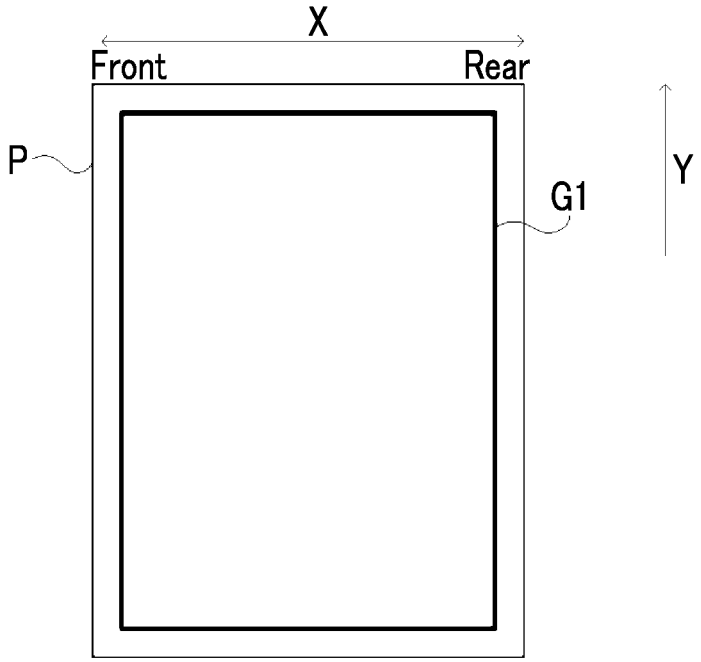
FIGS. 1A and 1B are schematic diagrams illustrating parallelism of an image transferred to a recording medium.

Hereinafter, an exemplary embodiment of the present disclosure will be described. Descriptions and examples illustrate the exemplary embodiment and do not limit the scope of the embodiments.

The numerical range indicated by using "to" in the present disclosure indicates a range including the numerical values before and after "to" as the minimum value and the maximum value, respectively.

In the numerical range described stepwise in the present disclosure, an upper limit value or a lower limit value described in one numerical range may be replaced with an upper limit value or a lower limit value of another numerical range described stepwise. In the numerical range described in the present disclosure, an upper limit value or a lower limit value of the numerical range may be replaced with value described in the examples.

In the present disclosure, the term "step" includes an independent process. In addition, even in a case where it is not possible to clearly distinguish a step from another step, this step is included in this term so long as the intended purpose of this step is achieved.

In a case where the exemplary embodiment is described with reference to the drawings in the present disclosure, the configuration of the embodiment is not limited to the configuration illustrated in the drawings. The size of the member in each drawing is conceptual, and the relative relation between the sizes of the members is not limited to the illustrations.

In the present disclosure, a component may contain a plurality of types of applicable substances. In a case where a plurality of types of substances applicable to each component in a composite are provided, the amount of each component in the composite in the present disclosure means the total amount of the plurality of types of substances provided in the composite unless otherwise specified.

Conductive Roll

A conductive roll according to the present exemplary embodiment includes a support member, an elastic layer disposed on an outer peripheral surface of the support member, and a top layer disposed on an outer peripheral surface of the elastic layer.

In a case where a pushing amount of a metal roll into the conductive roll is 1.7%, the metal roll having an outer diameter identical to an outer diameter of the conductive roll, a shrinkage rate of a surface of the conductive roll with respect to the outer diameter of the conductive roll is equal to or more than 5%.

Here, a method of calculating the shrinkage rate will be described.

The shrinkage rate is measured by pushing a metal roll having an outer diameter identical onto the outer diameter of the conductive roll (may be simply referred to as a "metal roll" below) to the conductive roll. A specific measurement procedure is as follows.

The "outer diameter" refers to the diameter of a roll cross section on a plane perpendicular to a rotation shaft of a roll (for example, conductive roll and metal roll).

The "metal roll" is a roll made of metal and refers to a roll having a shape which does not change in a case of being pushed to the conductive roll.

The shrinkage rate is calculated by the following expression using a "nip length" and a "roll arc length during non-nip", which are measured by a procedure as follows.

Expression: ("roll arc length during non-nip"−"nip length")÷("roll arc length during non-nip")×100

The Nip Length is Measured as Follows.

A surface of a conductive roll is coated with a liquid ink, and the conductive roll and a metal roll are brought into contact with each other with paper (manufactured by KOKUYO Co., Ltd., product name: KB paper for color copying) (having a thickness of 0.1 mm) interposed between the conductive roll and the metal roll, in a state where rotation shafts of the rolls are set to be parallel to each other. It is assumed that the size of the paper is larger than a nip surface formed by the conductive roll and the metal roll (surface obtained in a manner that the conductive roll and the metal roll come into contact with each other directly or with paper (having a thickness of 0.1 mm) interposed between the conductive roll and the metal roll when the metal roll is pushed onto the conductive roll. Then, the pushing amount of the metal roll into the conductive roll (may also be simply referred to as a "pushing ratio" below) is set to 1.7% with respect to the outer diameter of the conductive roll.

Here, the "pushing amount" refers to a distance that the metal roll is pushed and moved from the surface of the conductive roll toward the conductive roll.

Then, the metal roll is separated from the conductive roll and the paper, and the paper sandwiched between the conductive roll and the metal roll is taken out. The liquid ink existing on the nip surface formed by the conductive roll and the metal roll is transferred to the taken-out paper at the pushing ratio of 1.7%. Thus, by measuring the dimensions of a liquid ink image obtained by transfer to the paper, the dimensions of the nip surface at the pushing ratio of 1.7% can be measured.

A value obtained by measuring the length of the liquid ink image in a direction perpendicular to the rotation shafts of the conductive roll and the metal roll when the liquid ink is transferred is set to a "nip length".

The roll arc length during non-nip is calculated as follows.

First, a "radius r of a cross section of the conductive roll on the plane perpendicular to the rotation shaft of the conductive roll (also simply referred to as a "radius of the conductive roll" below)" and a "pushing amount a" are substituted into the following expression to calculate a contact arc angle θ.

Expression: $\cos(\theta/2)=(r-a)/r$ a: pushing amount (unit: mm)

r: radius of conductive roll (unit: mm)

θ: contact arc angle θ (Unit: °)

The contact arc angle θ calculated by the above expression corresponds to, in a case where the conductive roll and the metal roll are brought into contact with each other by the pushing amount a, the size of an angle formed by two straight lines formed by linking two termination points of a region in which the conductive roll and the metal roll are in contact with each other, to the rotation shaft of the conductive roll in a case where a cross section of the conductive roll in the plane perpendicular to the rotation shaft of the conductive roll is observed.

Figure 6:
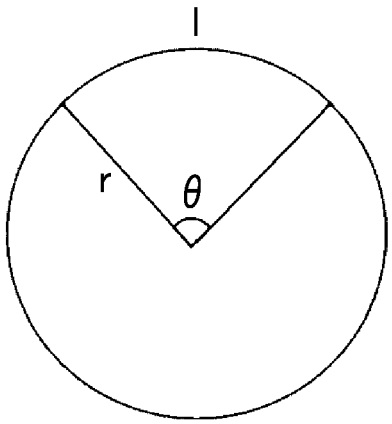
FIG. 6 is a schematic diagram illustrating a method of calculating a roll arc length during non-nip.

Then, as illustrated in FIG. 6, regarding the roll arc length during non-nip, an arc length l of a fan-shaped arc is calculated, and the calculated arc length l is set to the roll arc length during non-nip. At this time, the fan-shaped arc has a radius equal to the radius r of the conductive roll and has an angle at the central core, which is identical to the contact arc angle θ.

An expression for calculating the arc length l of the fan-shaped arc is as follows.

Expression: $l=2\pi r\times\theta/360$

With the above expression, the arc length l of the fan-shape arc is set to the roll arc length during non-nip.

The use of the conductive roll according to the present exemplary embodiment is not particularly limited so long as the conductive roll is used to press an outer peripheral surface onto a facing roll to form an insertion portion into which a recording medium is to be inserted, and to transfer an image to a recording medium at the insertion portion. That is, the conductive roll according to the present exemplary embodiment is used to press the outer peripheral surface onto the facing roll, insert a recording medium into the pushed region as an insertion portion, and transfer an image to the recording medium at the insertion portion.

Although not particularly limited, the conductive roll according to the present exemplary embodiment is used as a transfer roll, for example, in an electrophotographic image forming apparatus. The use of the conductive roll according to the present exemplary embodiment is not limited to the above description, and a primary transfer roll, a secondary transfer roll, a backup roll, and the like are exemplified.

With the above configuration, the conductive roll according to the present exemplary embodiment can easily increase the parallelism of an image transferred to a recording medium. The reason is presumed as follows.

In a case where the outer peripheral surface of the conductive roll is pressed on the facing roll, the insertion portion into which a recording medium is inserted is formed, and an image is transferred to the recording medium at the insertion portion, the parallelism of the image transferred to the recording medium may decrease.

Figure 1B:
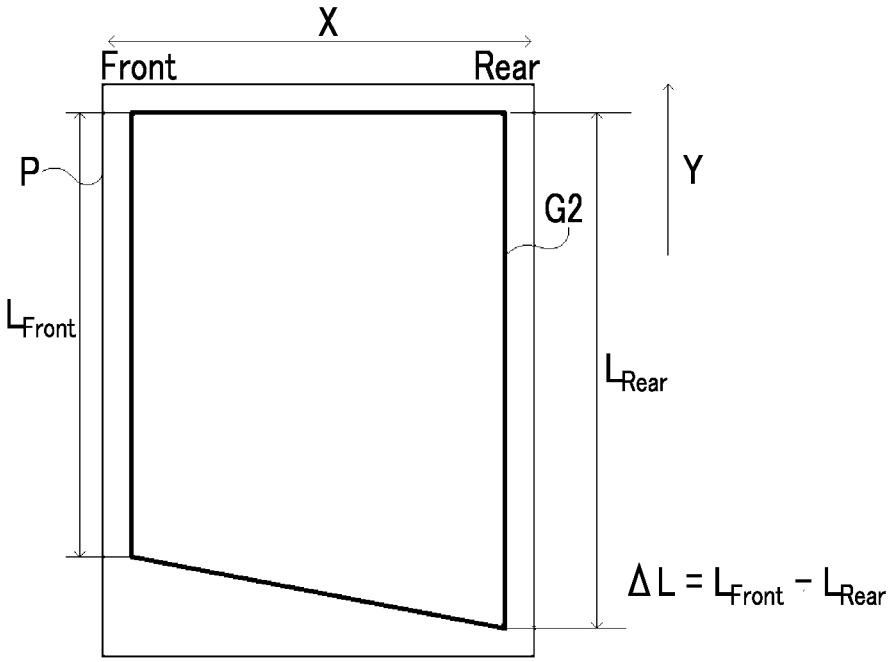

Here, the parallelism of the transferred image means a degree of the image being parallel to a direction (direction indicated by an arrow X in FIGS. 1A and 1B) perpendicular to a transport direction (direction indicated by an arrow Y in FIGS. 1A and 1B) of a recording medium P at the insertion portion. Specifically, the parallelism of the transferred image is represented, for example, by a difference $\Delta L$ ($=L_{Front}-L_{Rear}$) between a line image length $L_{Front}$ on one end side (denoted by Front in FIGS. 1A and 1B) in the direction indicated by the arrow X and a line image length $L_{Rear}$ on the other end side (denoted by Rear in FIGS. 1A and 1B) as illustrated in FIG. 1B, which are obtained from an image G2 actually transferred onto the recording medium P in a case where a rectangular image G1 configured by sides respectively parallel to sides of the recording medium P is intended to be formed on the recording medium P as illustrated in FIG. 1A.

As a method of correcting $\Delta L$ described above, a method of adjusting the pushing amount of the conductive roll into the facing roll at both ends of the conductive roll in an axial direction and making a different in a transport amount of a recording medium in the direction perpendicular to the transport direction of the recording medium is exemplified. In order to adjust the transport amount of the recording medium, for example, the surface of the conductive roll preferably tends to shrink in a case where the conductive roll is pushed into the facing roll, and the friction coefficient of the surface of the conductive roll is preferably high.

A conductive roll including an elastic foam as the outermost layer is exemplified as the conductive roll having a surface which tends to shrink in a case where the conductive roll is pushed into the facing roll. However, in the conductive roll having such a configuration, the friction coefficient of the surface of the conductive roll tends to be small, and thus it may not be possible to sufficiently adjust the transport amount of a recording medium. In a case where a resin layer having a high friction coefficient is provided as the outermost layer in order to increase the friction coefficient of the surface of the conductive roll, the surface may have a difficulty in shrinking in a case where the conductive roll is pushed into the facing roll.

As described above, it has been difficult for the conductive roll in the related art to have both the surface shrinkage and the surface friction coefficient in a favorable aspect.

A conductive roll according to the present exemplary embodiment includes a support member, an elastic layer disposed on an outer peripheral surface of the support member, and a top layer disposed on an outer peripheral surface of the elastic layer. Because the conductive roll includes the top layer disposed on the outer peripheral surface of the elastic layer, the friction coefficient of the surface of the conductive roll tends to be high.

In the conductive roll according to the present exemplary embodiment, in a case where a pushing amount of a metal roll into the conductive roll is 1.7%, the metal roll having an outer diameter identical to an outer diameter of the conductive roll, a shrinkage rate of a surface of the conductive roll with respect to the outer diameter of the conductive roll is equal to or more than 5%. By setting the shrinkage rate to be equal to or less than 5%, the surface of the conductive roll tends to shrink.

Therefore, it is presumed that the conductive roll according to the present exemplary embodiment easily increases the parallelism of the image transferred to the recording medium.

The conductive roll according to the present exemplary embodiment will be described with reference to the drawings.

Figure 2:
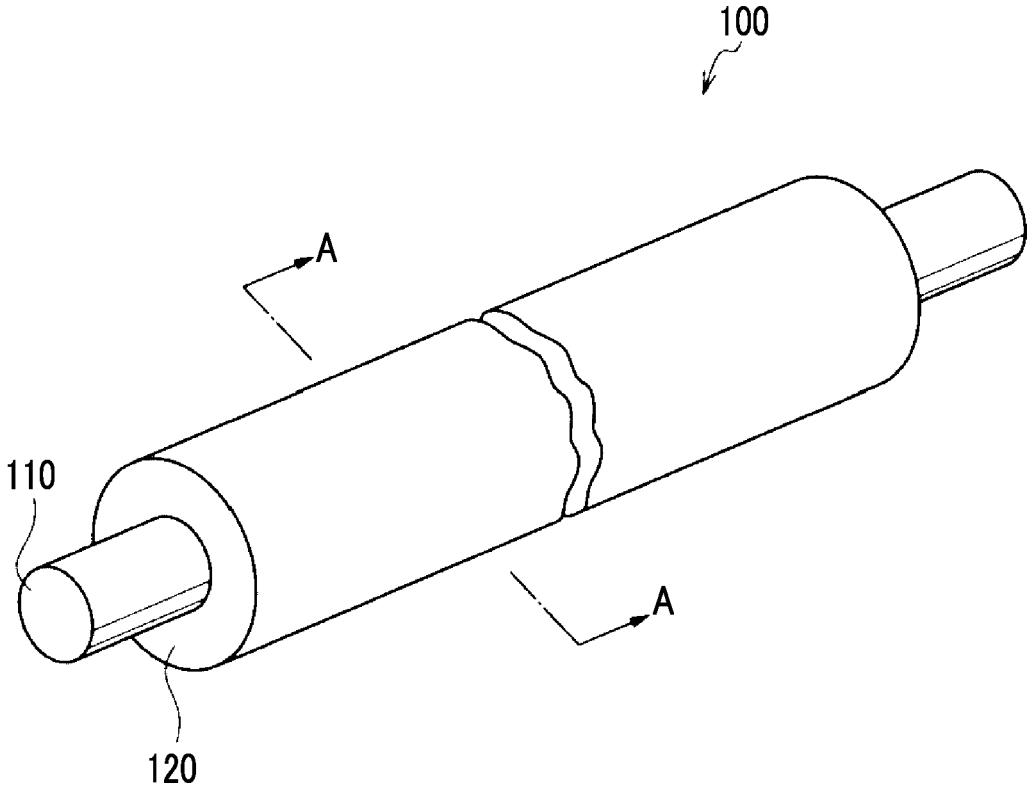
FIG. 2 is a schematic perspective view illustrating an example of a conductive roll according to an exemplary embodiment.
Figure 3:
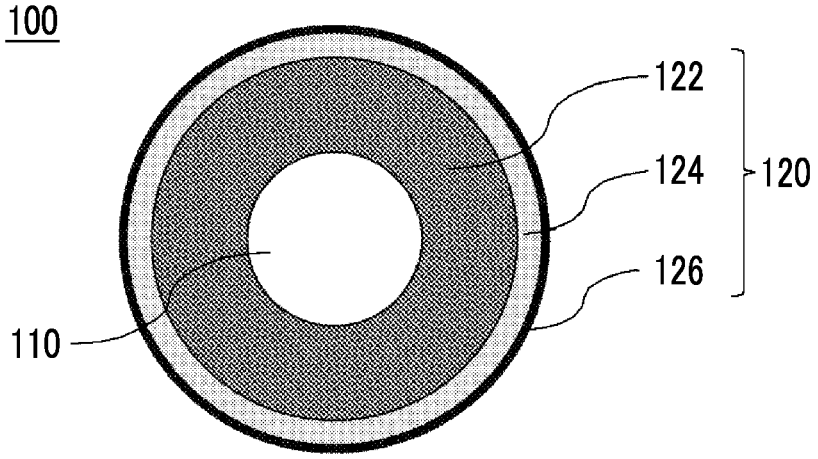
FIG. 3 is a schematic cross-sectional view illustrating an example of the conductive roll in the present exemplary embodiment, and is a cross-sectional view taken along line III-III in FIG. 2.

FIG. 2 is a schematic perspective view illustrating an example of the conductive roll according to the present exemplary embodiment. FIG. 3 is a cross-sectional view taken along line III-III in FIG. 2 and is a cross-sectional view obtained by cutting the conductive roll illustrated in FIG. 2 in a radial direction.

As illustrated in FIG. 2, a conductive roll 100 is a roll member configured to include a columnar support member 110 and a layered object 120. The layered object 120 includes an elastic layer and a top layer, which are disposed on an outer peripheral surface of the support member 110.

Here, the top layer may be a single layer or may be configured by a plurality of layers.

In a case where the top layer is configured by a plurality of layers, as illustrated in FIG. 3, for example, a layer configuration in which an elastic layer 122 disposed on an outer peripheral surface of a columnar support member 110, an intermediate layer 124 disposed on an outer peripheral surface of the elastic layer 122, and a surface layer 126 disposed on an outer peripheral surface of the intermediate layer 124 are provided is exemplified as a layer structure of the conductive roll 100. In a case where the top layer is configured by the plurality of layers, in the conductive roll according to the present exemplary embodiment, for example, the top layer is preferably configured by the intermediate layer 124 and the surface layer 126.

The conductive roll according to the present exemplary embodiment is not limited to the configuration illustrated in FIGS. 2 and 3. For example, an adhesive layer may be appropriately provided between the support member 110 and the elastic layer 122, between the elastic layer 122 and the intermediate layer 124, or between the intermediate layer 124 and the surface layer 126.

Materials and the like of each layer forming the conductive roll according to the present exemplary embodiment will be described below.

Support Member

In the conductive roll according to the present exemplary embodiment, the support member may be a member that functions as a support member of the conductive roll.

The support member may be a hollow member (that is, cylindrical member) or a solid member (that is, columnar member).

In a case where an electric field is formed between the conductive roll and the facing roll, the support member is preferably a conductive support member, for example.

Examples of the conductive support member include metal members made of iron (free-cutting steel and the like), copper, brass, stainless steel, aluminum, and nickel; resin members or ceramic members having an outer surface which is plated; and resin members or ceramic members containing a conductive agent.

The outer diameter of the support member may be determined in accordance with the use of the conductive roll.

For example, in a case where the conductive roll according to the present exemplary embodiment is a secondary transfer roll, the outer diameter of the support member may be equal to or more than 3 mm and equal to or less than 30 mm as an example.

Elastic Layer

The elastic layer is, for example, configured to contain an elastic material, a conductive agent, and, as necessary, other additives.

Examples of the elastic material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether ternary copolymer rubber, ethylene-propylene-diene ternary copolymer rubber (EPDM), acrylonitrile-butadiene copolymer rubber (NBR), natural rubber, and rubber obtained by mixing the above substances.

Examples of the conductive agent include an electronic conductive agent and an ionic conductive agent. Examples of the electronic conductive agent include powders of carbon blacks such as Ketjen black and acetylene black; thermally decomposed carbon and graphite; various conductive metals or alloys such as aluminum, copper, nickel, and stainless steel; various conductive metal oxides such as tin oxide, indium oxide, titanium oxide, tin oxide-antimony oxide solid solutions, and tin oxide-indium oxide solid solutions; and substances obtained by performing conduction treatment on a surface of an insulating material. Examples of the ionic conductive agent include perchlorates and chlorates such as tetraethylammonium and lauryl trimethylammonium; and alkali metals such as lithium and magnesium, and perchlorates and chlorates of alkaline earth metals.

Such a conductive agent may be used singly or in combination of two or more types.

Examples of the other additives include known materials that may be added to an elastic body, for example, softeners, plasticizers, curing agents, vulcanizing agents, vulcanization accelerators, antioxidants, surfactants, coupling agents, and fillers (silica, calcium carbonate, and the like).

For example, the elastic layer is preferably configured to include a cylindrical elastic foam and a conductive coating layer that covers the exposed surface of the elastic foam.

In the elastic layer having such a configuration, the intended conductivity is imparted by the conductive coating layer, and a soft elastic layer may be obtained in comparison to a case where a conductive agent is contained in the elastic foam. In this manner, a conductive roll having a surface that tends to shrink in a case where the conductive roll is pushed into the facing roll tends to be obtained, and a conductive roll that easily increases the parallelism of an image transferred to a recording medium tends to be obtained.

Elastic Foam

The elastic foam forming the elastic layer is a foam containing an elastic material (also referred to as a rubber material).

As the elastic material, the above-described substances are applied.

Examples of a foaming agent for obtaining the elastic foam include water; azo compounds such as azodicarbonamide, azobisisobutyronitrile, and diazoaminobenzene; benzene sulfonyl hydrazides such as benzene sulfonyl hydrazide, 4,4'-oxybisbenzene sulfonyl hydrazide, and toluene sulfonyl hydrazide; bicarbonates such as sodium hydrogen carbonate that generate carbon dioxide by thermal decomposition; mixtures of $NaNO_2$ and $NH_4Cl$ that generate a nitrogen gas; and peroxides that generate oxygen.

In order to obtain the elastic foam, as necessary, a foaming aid, a foam stabilizer, a catalyst, and the like may be used.

The elastic foam may contain a conductive agent from a viewpoint of controlling the conductivity of the elastic layer.

Examples of the conductive agent contained in the elastic foam include an electronic conductive agent and an ionic conductive agent.

From a viewpoint of setting the shrinkage rate of the conductive roll in a favorable range, for example, the content of the conductive agent (particularly in the case of an electronic conductive agent) in the elastic foam is equal to or less than 1% by mass, preferably equal to or less than 0.5% by mass, and more preferably equal to or less than 0% by mass, with respect to the total mass of the elastic foam.

For example, that is it is preferable that the amount of the electronic conductive agent in the elastic foam is small. Even in a case where the elastic foam contains conductive particles, the content of the electronic conductive agent is intended to be equal to or less than 1% by mass with respect to the total mass of the elastic foam.

In a case where the elastic foam contains particulates of the electronic conductive agent, the filler, and the like described above, the hardness of the elastic layer tends to increase, and the peelability of the medium tends to decrease. Therefore, for example it is preferable that the amount of the particulates in the elastic foam is small. Even in a case where the elastic foam contains conductive particles, the total content of the particulates is preferably equal to or less than 1% by mass with respect to the total mass of the elastic foam, for example.

For example, the bubble structure in the elastic foam is preferably an open cell structure from a viewpoint of the formability of the conductive coating layer and from a viewpoint of obtaining the conductive roll that easily increases the parallelism of an image transferred to a recording medium.

Here, the open cell structure means a structure in which adjacent cells (that is, bubbles) communicate with each other and a portion of the communicating cell is exposed (open) to the surface.

For example, the elastic foam having a small closed cell ratio is preferable, and the closed cell ratio is preferably, for example, equal to or less than 50% (preferably, equal to or less than 30%).

For example, from a viewpoint of the formability of the conductive coating layer and from a viewpoint of obtaining the conductive roll that easily increases the parallelism of an image transferred to a recording medium, the cell diameter (also referred to as a bubble diameter) of the elastic foam is preferably equal to or more than 50 μm and equal to or less than 1000 μm, more preferably equal to or more than 100 μm and equal to or less than 800 μm, and further equal to or more than 150 μm and equal to or less than 600 μm.

For example, from a viewpoint of the formability of the conductive coating layer and from a viewpoint of obtaining the conductive roll that easily increases the parallelism of an image transferred to a recording medium, the density (also referred to as a bubble ratio) of the elastic foam is preferably equal to or more than 50 $kg/m^3$ and equal to or less than 90 $kg/m^3$, more preferably equal to or more than 55 $kg/m^3$ and equal to or less than 85 $kg/m^3$, and further equal to or more than 60 $kg/m^3$ and equal to or less than 80 $kg/m^3$.

Here, the cell diameter (bubble diameter), a foaming ratio (bubble ratio), and the closed cell ratio in the elastic foam are measured in a manner as follows.

First, a cross section of the elastic layer (elastic foam in the elastic layer) in a thickness direction is produced using a razor. Four cross sections in total are produced in parallel with the axial direction of the conductive roll and in 90° increments in a circumferential direction.

The central portion of the cross section in the axial direction is photographed with a laser microscope (KEYENCE CORPORATION, VK-X200) to acquire an image. The image is analyzed with image analysis software (Media Cybernetics, Image-Pro Plus), and the maximum diameter and the area of the cell (bubble) are measured.

In a case where the elastic foam has an open cell structure, the continuous state of cells (bubbles) is estimated from the shape of open cells. The cells which are continuous (connected) are pseudo-separated from each other, and the maximum diameter of the separated cell is obtained. That is, in a case where it is presumed that the open cells have a shape in which, for example, five bubbles are continuous (connected), the five cells are pseudo-separated into five, and the maximum diameter of the separated five cells is measured.

The arithmetic mean of the maximum diameter of 100 cells which are randomly selected is calculated in the analyzed cross-sectional image, and the arithmetic mean of four cross-sections is calculated based on the obtained value. The value obtained in this manner is set to the cell diameter.

The foaming ratio is obtained by (total area of cells in the analyzed cross-sectional image)/(total area of the analyzed cross-sectional image)×100.

The closed cell ratio is obtained by (total area of closed cells in the analyzed cross-sectional image)/(total area of bubbles in the analyzed cross-sectional image)×100.

Here, the closed cells refer to bubbles that are all surrounded by a wall surface in the cross-sectional image.

The density of the elastic foam is measured in a manner as follows.

A cube is produced using the elastic layer (elastic foam in the elastic layer) and a razor. In a case where the cube is produced as large as possible, the density can be measured accurately. Then, the length, the width, and the height of the cube are measured, and the volume is calculated. Then, the weight is measured, and the density is obtained from the weight/volume.

Formation of Elastic Foam

A method of forming the cylindrical elastic foam is not particularly limited, and a known method is used.

For example, methods as follows are exemplified: a method of preparing a composite containing an elastic material, a foaming agent, and other components used as necessary (for example, vulcanizing agent), extruding the composite into a cylindrical shape, and then heating the molded article to perform vulcanization and foaming; and a method of cutting out a large foam into a cylindrical shape.

After a columnar elastic foam is formed, a center hole for inserting the support member may be formed to obtain the cylindrical elastic foam.

After the cylindrical elastic foam is obtained, as necessary, the shape may be further adjusted or post-treatment such as polishing the surface may be performed.

Conductive Coating Layer

The conductive coating layer forming the elastic layer is a conductive layer that covers the exposed surface of the elastic foam (that is, including an inner peripheral surface, an outer peripheral surface, and a cell wall surface of the cylindrical elastic foam, which are contact surfaces of the elastic foam with the atmosphere).

The exposed surface of the elastic foam may be entirely covered by the conductive coating layer, or may be partially covered.

A treatment liquid containing a conductive agent and resin is used to form the conductive coating layer.

Here, examples of the conductive agent used in the treatment liquid include an electronic conductive agent and an ionic conductive agent. Among the agents, the electronic conductive agent is favorable.

The conductive agent contained in the treatment liquid may be one type or two or more types.

Here, examples of the electronic conductive agent are similar to the examples of the electronic conductive agent contained in the elastic foam, and the favorable examples is also similar.

The resin used for the treatment liquid is not particularly limited as long as the resin may be used to form a coating layer on the exposed surface of the elastic foam. Examples of the resin include acrylic resin, urethane resin, fluororesin, and silicone resin. Such resin is preferably used as latex, for example.

Examples of latex include natural rubber latex, butadiene rubber latex, acrylonitrile-butadiene rubber latex, acrylic rubber latex, polyurethane rubber latex, fluororubber latex, and silicone rubber latex, in addition to the above resin latex.

For example, the treatment liquid is preferably an aqueous dispersion liquid containing a conductive agent, resin, and water, that is, the conductive agent and the resin.

The concentrations of the conductive agent and the resin in the treatment liquid may be determined in accordance with the formability of the conductive coating layer, the resistance value intended for the elastic layer, and the like.

Formation of Conductive Coating Layer

The conductive coating layer is formed by applying a treatment liquid to the elastic foam and heating and drying the resultant.

Examples of a method of applying the treatment liquid to the elastic foam include a method of coating the elastic foam with the treatment liquid by spray coating and the like, and a method of immersing the elastic foam in the treatment liquid.

With the above methods, the treatment liquid is impregnated into the surface of the elastic foam and the inside of the bubbles. Then, the elastic foam to which the treatment liquid is adhered is dried by heating or the like to form the conductive coating layer.

As the conductive coating layer, for example, the coating layer and the forming method thereof disclosed in JP2009-244824A and the like may be applied.

In this manner, by forming the conductive coating layer on the exposed surface of the elastic foam, the elastic layer in the conductive roll according to the present exemplary embodiment is formed.

Volume Resistance Value of Elastic Layer

In the conductive roll according to the present exemplary embodiment, for example, the volume resistance value of the elastic layer in a case where a voltage of 10 V is applied is preferably equal to or less than $10^5\Omega$, more preferably equal to or more than $10^1\Omega$ and equal to or less than $10^5\Omega$, and further preferably equal to or more than $10^2\Omega$ and equal to or less than $10^4\Omega$.

Here, the volume resistance value of the elastic layer is measured in a manner as follows.

First, a roll member in which an elastic layer to be measured is provided on the outer periphery of a conductive support member is produced, and the volume resistance value of the elastic layer is measured using the obtained roll member. In a case where the conductive roll according to the present exemplary embodiment includes a conductive support member, a roll member in which a top layer is peeled off from the conductive roll may be measured.

The roll member is placed on a metal plate such as a copper plate with a load of 500 g on both end portions of the roll member. A voltage (V) of 10 V (in the case of the elastic layer) is applied between the conductive support member of the roll member and the metal plate, by using a minute current measuring device (R8320 manufactured by Advantest CORPORATION). Then, a current value I (A) after seconds is read, and the volume resistance value is obtained by calculation with the following expression.

Expression: Volume resistance value $Rv$ (Ω)=$V/I$

The measurement is performed under an environment of a temperature of 22° C. and humidity of 55% RH.

Thickness of Elastic Layer

In the conductive roll according to the present exemplary embodiment, the thickness of the elastic layer may be determined in accordance with the use of the conductive roll.

For example, in a case where the conductive roll according to the present exemplary embodiment is a secondary transfer roll, the thickness of the elastic layer may be equal to or more than 1 mm and equal to or less than 10 mm as an example.

Top Layer

In the conductive roll according to the present exemplary embodiment, the top layer is disposed on the outer peripheral surface of the elastic layer.

The top layer is a layer forming the outermost surface of the conductive roll, and is configured by a single layer or a plurality of layers.

(1) A case where the top layer is configured by a single layer and (2) a case where the top layer is configured by a plurality of layers will be separately described below.

(1) Top Layer in Case of being Configured by Single Layer

The top layer is disposed on the outer peripheral surface of the elastic layer.

The top layer is a layer that contributes to the resistance adjustment of the conductive roll. For example, the volume resistance value of the top layer in a case where a voltage of 100 V is applied is preferably equal to or more than $10^4$Ω and equal to or less than $10^9$Ω (more preferably equal to or more than $10^6$Ω and equal to or less than $10^9$Ω).

The volume resistance value of the top layer is measured by a method similar to the method for the volume resistance value of the elastic layer.

For example, the top layer preferably contains a conductive agent in order to achieve the above volume resistance value.

As the conductive agent, any of an electronic conductive agent and an ionic conductive agent is used. Among the agents, for example it is preferable to use the ionic conductive agent from a viewpoint of improving charge retention.

That is, the top layer preferably contains the ionic conductive agent. Examples of the ionic conductive agent contained in the top layer include conductive agents which are the same as the ionic conductive agents contained in the elastic foam, and the preferable examples is also similar.

The ionic conductive agent may be used singly, or in combination of two or more types.

The ionic conductive agent used for the top layer may be a polymer material having ionic conductivity, such as epichlorohydrin rubber, epichlorohydrin-ethylene oxide copolymer rubber, and epichlorohydrin-ethylene oxide-allyl glycidyl ether ternary copolymer rubber.

The ionic conductive agent used for the top layer may be a compound in which an ionic conductive agent is bonded to the termination of a polymer material such as resin.

The content of the ionic conductive agent may be in a range in which the above-described volume resistance value may be achieved.

In a case where the top layer contains a binder material, for example, the content of the ionic conductive agent is preferably equal to or more than 0.1 parts by mass and equal to or less than 5.0 parts by mass, and more preferably equal to or more than 0.5 parts by mass and equal to or less than 3.0 parts by mass, with respect to 100 parts by mass of the binder material.

The top layer may contain a binder material in addition to the ionic conductive agent.

The binder material is not particularly limited, and examples of the binder material include resin and an elastic material that may form the top layer. Examples of the resin used for the top layer include urethane resin, acrylic resin, epoxy resin, and silicone resin. As the elastic material contained in the top layer, materials similar to the elastic materials used for the elastic layer are used.

The top layer may contain other additives in accordance with physical properties and the like required for the top layer.

(2) Top Layer in Case of being Configured by Plurality of Layers

In a case where the top layer is configured by a plurality of layers, for example, the top layer is preferably configured to include an intermediate layer disposed on the outer peripheral surface of the elastic layer and a surface layer disposed on the outer peripheral surface of the intermediate layer.

Intermediate Layer

The intermediate layer has a configuration identical to the configuration of the top layer in a case (1) where the top layer is configured by a single layer.

Surface Layer

The surface layer is a layer disposed on the outer peripheral surface of the intermediate layer, and is a layer forming the outermost surface of the conductive roll.

Because the surface layer comes into contact with a medium, for example it is preferable that the surface layer has releasability.

For example, the surface layer is preferably a layer containing resin.

The resin contained in the surface layer is not particularly limited, and examples of such resin include urethane resin, polyester resin, phenol resin, acrylic resin, epoxy resin, and cellulose resin.

For example, the surface layer preferably contains a conductive agent.

Examples of the conductive agent contained in the surface layer include an electronic conductive agent and an ionic conductive agent.

As the electronic conductive agent contained in the surface layer, an electronic conductive agent similar to the electronic conductive agent used in the conductive coating layer is used. As the ionic conductive agent contained in the surface layer, an ionic conductive agent similar to the ionic conductive agent used in the intermediate layer is used.

In a case where the surface layer contains resin, for example, the content of the ionic conductive agent is preferably equal to or more than 0.1 part by mass and equal to or less than 5.0 parts by mass, and more preferably equal to or more than 0.5 part by mass and equal to or less than 3.0 parts by mass, with respect to 100 parts by mass of the resin contained in the surface layer.

The surface layer may contain other additives in accordance with physical properties and the like required for the surface layer.

For example, the volume resistance value of the surface layer in a case where a voltage of 10 V is applied is preferably equal to or more than $10^4\Omega$ and equal to or less than $10^{14}\Omega$, and more preferably equal to or more than $10^6\Omega$ and equal to or less than $10^{12}\Omega$.

The volume resistance value of the surface layer is measured in a manner as follows based on JIS K 6911 (2006).

First, a single-layer sheet using the material of the surface layer is produced, and the volume resistivity is measured using the obtained single-layer sheet. The appropriate thickness of the sheet is 0.2 mm. The single-layer sheet is placed between circular electrodes (front electrode and back electrode). A voltage (V) of 10 V is applied by using a minute current measuring device (R8320 manufactured by Advantest CORPORATION). Then, a current value I (A) after 5 seconds is read, and the volume resistance value is obtained by calculation with the following expression.

Expression: Volume resistance value $Rv\ (\Omega)=V/I$

In the conductive roll according to the present exemplary embodiment, the thickness of the surface layer may be determined in accordance with the use of the conductive roll.

For example, in a case where the conductive roll according to the present exemplary embodiment is a secondary transfer roll, the thickness of the surface layer may be equal to or more than 0.01 mm and equal to or less than 0.05 mm as an example.

For example, the Young's modulus of the surface layer is preferably equal to or more than 50 MPa, and more preferably equal to or more than 50 MPa and equal to or less than 400 MPa.

A method of measuring the Young's modulus of the surface layer will be described later.

A method of forming the surface layer is not particularly limited. For example, a method of applying a coating liquid for forming a surface layer onto the intermediate layer and drying the obtained coated film is exemplified.

Characteristics of Top Layer

The characteristics of the top layer being a single layer and the characteristics of the top layer configured by the plurality of layers will be described below.

Friction Coefficient of Top Layer

For example, the friction coefficient of the outer peripheral surface of the top layer is preferably equal to or more than 0.2, more preferably equal to or more than 0.3, and further preferably equal to or more than 0.4.

The upper limit value of the friction coefficient of the outer peripheral surface of the top layer is not particularly limited, but is preferably equal to or less than 0.7 from a viewpoint of improving the peelability of the recording medium, for example.

By setting the friction coefficient of the outer peripheral surface of the top layer to be equal to or more than 0.2, it is easier to adjust the transport amount of the recording medium. Therefore, a conductive roll that easily increases the parallelism of an image transferred to a recording medium tends to be obtained.

The friction coefficient of the outer peripheral surface of the top layer is a friction coefficient with respect to SUS, which is measured by the following procedure.

Specifically, a static friction coefficient is measured using TRIBOGEAR-Type 14FW manufactured by HEIDON Corp. It is assumed that the measurement position is one point at the center of the conductive roll in the axial direction. The measurement is performed three times at every 120° in the circumferential direction in the similar procedure, and the arithmetic mean value of the obtained three measured values is set as the friction coefficient of the outer peripheral surface of the top layer.

Thicknesses Ts and Tm

For example, the thickness Ts of the top layer in a case where the top layer is a single layer and the thickness Tm of the intermediate layer in a case where the top layer is configured by a plurality of layers are preferably equal to or more than 0.5 mm and equal to or less than 5 mm, more preferably equal to or more than 0.7 mm and equal to or less than 4 mm, and further preferably equal to or more than 0.8 mm and equal to or less than 3 mm.

By setting the thickness Ts of the top layer and the thickness Tm of the intermediate layer in a range of being equal to or more than 0.5 mm and equal to or less than 5 mm, the surface of the conductive roll in a case where the conductive roll is pushed into the facing roll is more likely to shrink. Therefore, a conductive roll that easily increases the parallelism of an image transferred to a recording medium tends to be obtained.

Characteristics of Conductive Roll

In a case where the pushing amount of the metal roll into the conductive roll is 1.7%, the metal roll having an outer diameter identical to the outer diameter of the conductive roll, the shrinkage rate of the surface of the conductive roll with respect to the outer diameter of the conductive roll is equal to or more than 5%.

The method of calculating the shrinkage rate is as described above.

From a viewpoint of easily obtaining a conductive roll in which the surface of the conductive roll in a case where the conductive roll is pushed into the facing roll is more likely to shrink and the parallelism of an image transferred to a recording medium is more easily increased, in a case where the pushing ratio is 1.7%, for example, the shrinkage rate of the surface of the conductive roll is preferably equal to or more than 5% and equal to or less than 20%, more preferably equal to or more than 6% and equal to or less than 15%, and further preferably equal to or more than 7% and equal to or less than 10%.

Young's modulus

In a case where the top layer is a single layer, for example, the Young's modulus Yd of the elastic layer and the Young's modulus Ys of the top layer may satisfy the following expression (1-1).

In a case where the top layer is configured by a plurality of layers, for example, the Young's modulus Yd of the elastic layer and the Young's modulus Ym of the intermediate layer may satisfy the following expression (2-1).

$Yd<Ys$ Expression (1-1):

$Yd<Ym$ Expression (2-1):

In a case where the Young's moduli satisfy the above expressions, the intermediate layer and the top layer are easily deformed to a dogleg shape. Thus, a nip portion tends to shrink. Therefore, the nip portion shrinks largely, and thus a conductive roll that easily increases the parallelism of an image transferred to a recording medium tends to be obtained.

In a case where the top layer is a single layer, for example, the Young's modulus Yd of the elastic layer and the Young's modulus Ys of the top layer preferably may satisfy the following expression (1-2).

In a case where the top layer is configured by a plurality of layers, for example, the Young's modulus Yd of the elastic layer and the Young's modulus Ym of the intermediate layer may satisfy the following expression (2-2).

$$10 \leq Ys/Yd \leq 10000 \quad \text{Expression (1-2):}$$

$$10 \leq Ym/Yd \leq 1000 \quad \text{Expression (2-2):}$$

In a case where the Young's moduli satisfy the above expressions, deformation of the intermediate layer and the top layer is not hindered by the flexible elastic layer, and the nip portion shrinks. Thus, a conductive roll that easily increases the parallelism of an image transferred to a recording medium tends to be obtained.

From a viewpoint of easily obtaining a conductive roll that further easily increases the parallelism of an image transferred to a recording medium, for example, the Young's moduli Yd and Ys more preferably satisfy the following expression (1-3), and further preferably satisfy the following expression (1-4).

$$15 \leq Ys/Yd \leq 9000 \quad \text{Expression (1-3):}$$

$$20 \leq Ys/Yd \leq 8000 \quad \text{Expression (1-4):}$$

From the viewpoint of easily obtaining a conductive roll that further easily increases the parallelism of an image transferred to a recording medium, for example, the Young's moduli Yd and Ym more preferably satisfy the following expression (2-3), and further preferably satisfy the following expression (2-4).

$$15 \leq Ym/Yd \leq 900 \quad \text{Expression (2-3):}$$

$$20 \leq Ym/Yd \leq 800 \quad \text{Expression (2-4):}$$

The Young's modulus of each layer is measured in a manner as follows.

A method of measuring the Young's modulus of each layer basically conforms to ISO527.

Regarding the intermediate layer and the elastic layer, a dumbbell-type tensile test piece in which an inter-mark line distance is 50 mm, the thickness of the elastic layer is 5 mm, and the thickness of the intermediate layer is 1 mm is produced. A stress ($\sigma$)-strain ($\varepsilon$) curve at a tensile speed of 5 mm/min is obtained by a desktop precision universal testing machine (AGS-X; manufactured by Shimadzu Corporation). The stress at the strain of 0.05% to 0.25% is measured, and the Young's modulus is obtained from $\Delta\sigma/\Delta\varepsilon$.

The Young's modulus of the surface layer is obtained by the similar method to the method of measuring the Young's moduli of the intermediate layer and the elastic layer except that the composition of the surface layer is analyzed, and coating, forming, and firing with a fluororesin mold are performed, and thus a dumbbell-type tensile test piece having an inter-mark line distance of 50 mm and a thickness of 0.2 mm and having a composition identical to the composition of the surface layer is produced, and the produced tensile test piece is used.

Volume Resistance Value of Conductive Roll

In the conductive roll according to the present exemplary embodiment, for example, the volume resistance value in a case where a voltage of 1000 V is applied to the conductive roll is preferably equal to or more than $10^4\Omega$ and equal to or less than $10^{12}\Omega$, more preferably equal to or more than $10^5\Omega$ and equal to or less than $10^{11}\Omega$, and further preferably equal to or more than $10^6\Omega$ and equal to or less than $10^{10}\Omega$.

The volume resistance value of the conductive roll is measured in a manner similar to the method for the volume resistance value of the elastic layer.

Image Forming Apparatus, Transfer Device, and Process Cartridge

Figure 4:
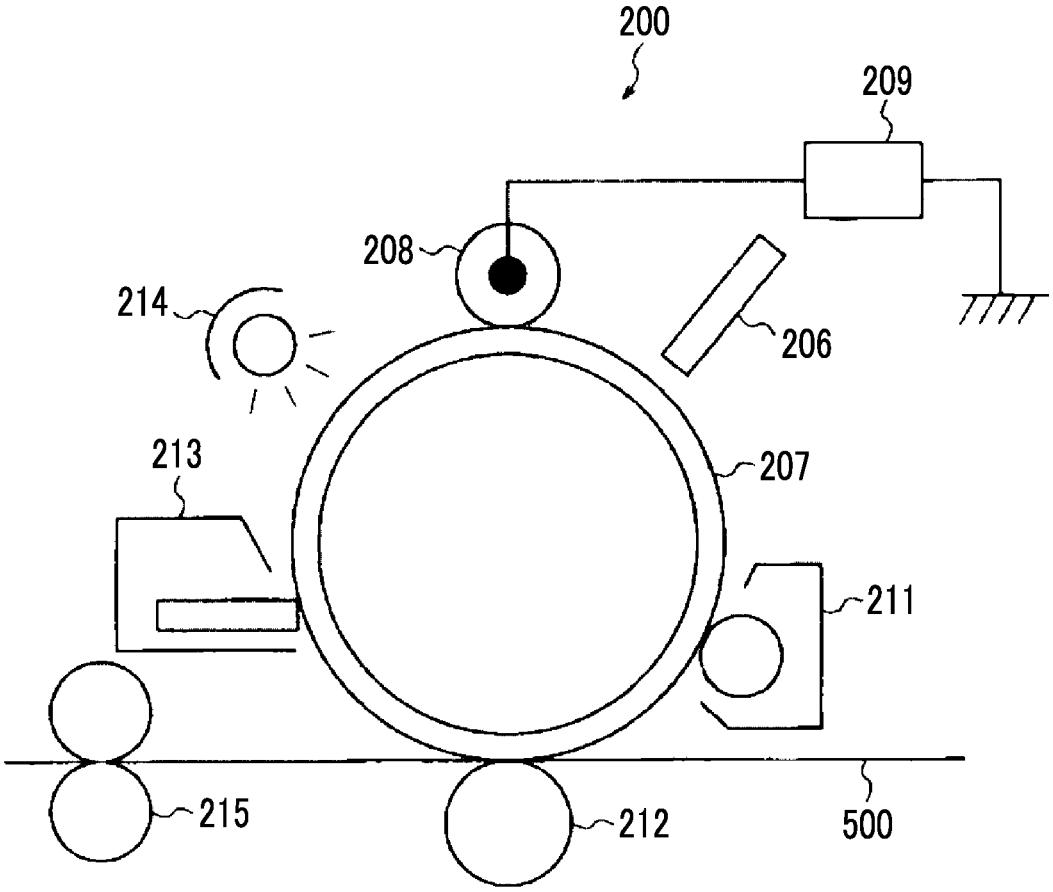
FIG. 4 is a schematic configuration diagram illustrating an example of an image forming apparatus according to the present exemplary embodiment.

FIG. 4 is a schematic configuration diagram illustrating a direct transfer type image forming apparatus which is an example of an image forming apparatus according to the present exemplary embodiment.

An image forming apparatus 200 illustrated in FIG. 4 includes a photoconductor 207 (an example of an image holding member), a charging roll 208 (an example of a charging device), an exposure device 206 (an example of an electrostatic charge image forming device), a developing device 211 (an example of a developing device), and a transfer roll 212 (an example of a transfer device and an example of a transfer device according to the present exemplary embodiment). The charging roll 208 charges the surface of the photoconductor 207. The exposure device 206 forms an electrostatic charge image on the charged surface of the photoconductor 207. The developing device 211 develops the electrostatic charge image formed on the surface of the photoconductor 207, as a toner image, with a developer containing a toner. The transfer roll 212 transfers the toner image formed on the surface of the photoconductor 207, to the surface of a recording medium.

Here, the conductive roll according to the present exemplary embodiment is applied to the transfer roll 212 that forms an insertion portion through which recording paper 500 is inserted, by pressing the outer peripheral surface against the photoconductor 207 corresponding to the facing roll.

The image forming apparatus 200 illustrated in FIG. 4 further includes a cleaning device 213, an erasing device 214, and a fixing device 215 (an example of fixing means). The cleaning device 213 removes the toner remaining on the surface of the photoconductor 207. The erasing device 214 erases the electricity of the surface of the photoconductor 207. The fixing device 215 fixes the toner image to a recording medium.

The charging roll 208 may be a contact charging type or a non-contact charging type. A voltage from a power source 209 is applied to the charging roll 208.

Examples of the exposure device 206 include an optical device including a light source such as a semiconductor laser and a light emitting diode (LED).

The developing device 211 is a device that supplies a toner to the photoconductor 207. For example, the developing device 211 brings a roll-shaped developer holding member in contact with or close to the photoconductor 207, and adheres the toner to the electrostatic charge image on the photoconductor 207 to form a toner image.

The transfer roll 212 is a transfer roll that comes into direct contact with the surface of a recording medium, and is disposed at a position facing the photoconductor 207. The recording paper 500 (an example of a recording medium) is supplied to a gap at which the transfer roll 212 and the photoconductor 207 are in contact with each other, through a supply mechanism. In a case where a transfer bias is applied to the transfer roll 212, an electrostatic force from the photoconductor 207 toward the recording paper 500 acts on the toner image, and the toner image on the photoconductor 207 is transferred to the recording paper 500.

Examples of the fixing device 215 include a heating fixing device including a heating roll and a pressure roll that presses against the heating roll.

Examples of the cleaning device 213 include devices including blades, brushes, rolls, and the like as cleaning members.

The erasing device 214 is, for example, a device that irradiates the surface of the photoconductor 207 after the transfer with light to erase the residual potential of the photoconductor 207.

The photoconductor 207 and the transfer roll 212 may have, for example, a cartridge structure (process cartridge according to the present exemplary embodiment) in which the photoconductor 207 and the transfer roll 212 are integrated by one housing. The cartridge structure is attachable to and detachable from the image forming apparatus. The cartridge structure (process cartridge according to the present exemplary embodiment) may further include at least one selected from the group consisting of the charging roll 208, the exposure device 206, the developing device 211, and the cleaning device 213.

The image forming apparatus is a tandem type image forming apparatus in which a photoconductor 207, a charging roll 208, an exposure device 206, a developing device 211, a transfer roll 212, and a cleaning device 213 are used as one image forming unit, and a plurality of the image forming units are mounted side by side.

Figure 5:
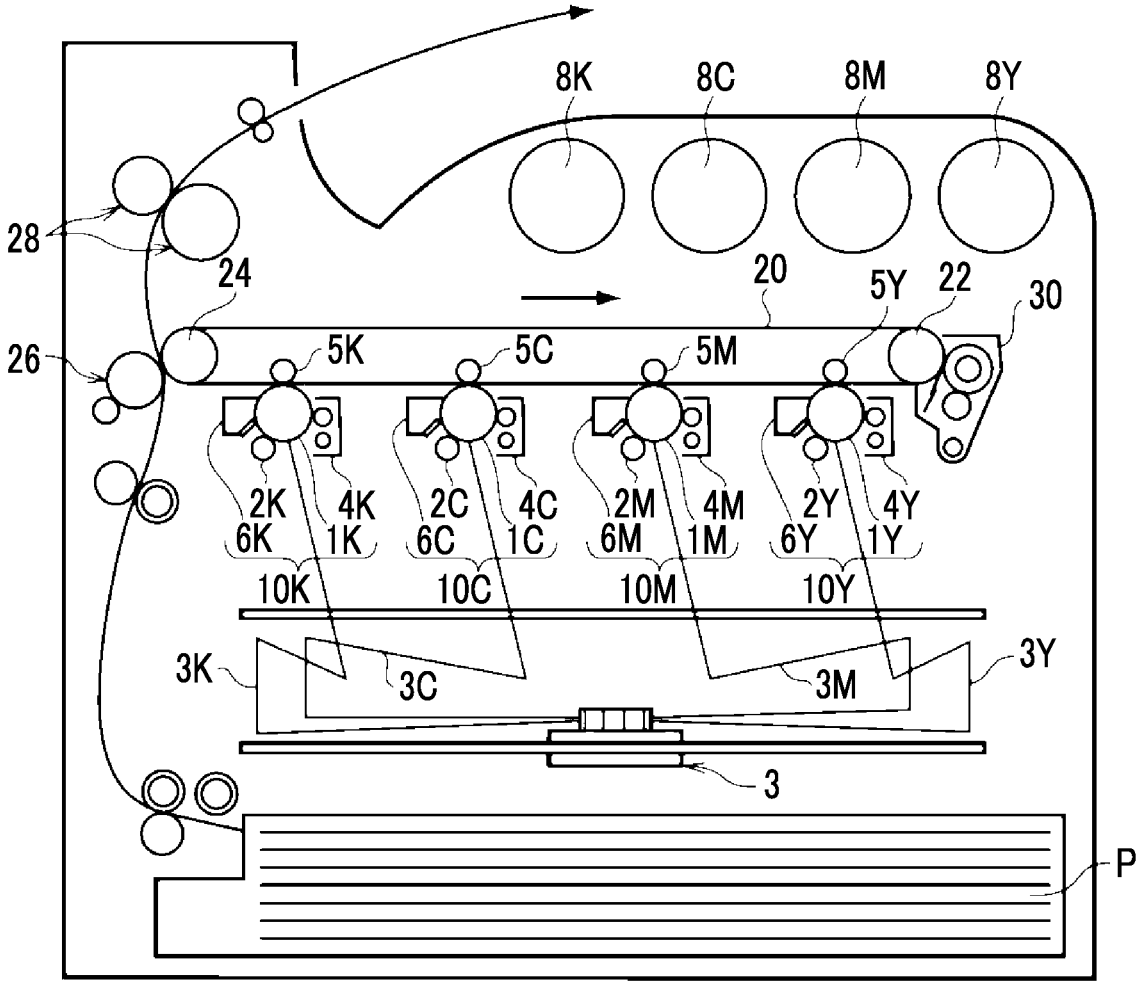
FIG. 5 is a schematic configuration diagram illustrating another example of the image forming apparatus in the present exemplary embodiment.

FIG. 5 is a schematic configuration diagram illustrating an intermediate transfer type image forming apparatus which is an example of an image forming apparatus according to the present exemplary embodiment. The image forming apparatus illustrated in FIG. 5 is a tandem type image forming apparatus in which four image forming units are arranged in parallel.

In the image forming apparatus illustrated in FIG. 5, the transfer device that transfers the toner image formed on the surface of the image holding member to the surface of the recording medium is configured as a transfer unit (an example of the transfer device according to the present exemplary embodiment) that includes an intermediate transfer member, a primary transfer device, and a secondary transfer device. The transfer unit may have a cartridge structure that is attachable to and detachable from the image forming apparatus.

The image forming apparatus illustrated in FIG. 5 includes a photoconductor 1 (an example of the image holding member), a charging roll 2 (an example of the charging device), an exposure device 3 (an example of the electrostatic charge image forming device), a developing device 4 (an example of the developing device), an intermediate transfer belt 20 (an example of the intermediate transfer member), a primary transfer roll 5 (an example of the primary transfer device), and a secondary transfer roll 26 (an example of the secondary transfer device). The charging roll 2 charges the surface of the photoconductor 1. The exposure device 3 forms an electrostatic charge image on the charged surface of the photoconductor 1. The developing device 4 develops the electrostatic charge image formed on the surface of the photoconductor 1, as a toner image, with a developer containing a toner. The primary transfer roll 5 transfers the toner image formed on the surface of the photoconductor 1, to the surface of the intermediate transfer belt 20. The secondary transfer roll 26 transfers the toner image transferred to the surface of the intermediate transfer belt 20, to the surface of a recording medium.

Here, the conductive roll according to the present exemplary embodiment is applied to the secondary transfer roll 26 that forms an insertion portion through which recording paper P is inserted, by pressing the outer peripheral surface against a support roll 24 corresponding to the facing roll.

The image forming apparatus illustrated in FIG. 5 further includes a fixing device 28 (an example of the fixing means), a photoconductor cleaning device 6, and an intermediate-transfer-belt cleaning device 30. The fixing device 28 fixes the toner image to the recording medium. The photoconductor cleaning device 6 removes the toner remaining on the surface of the photoconductor 1. The intermediate-transfer-belt cleaning device 30 removes the toner remaining on the surface of the intermediate transfer belt 20.

The image forming apparatus illustrated in FIG. 5 includes first to fourth electrophotographic image forming units 10Y, 10M, 10C, and 10K that output images of colors of yellow (Y), magenta (M), cyan (C), and black (K) based on color-separated pieces of image data. The image forming units 10Y, 10M, 10C, and 10K are arranged side by side so as to be spaced from each other in a horizontal direction. The image forming units 10Y, 10M, 10C, and 10K may be process cartridges that are attachable to and detachable from the image forming apparatus, respectively.

The intermediate transfer belt 20 is provided above the image forming units 10Y, 10M, 10C, and 10K to extend with passing by the image forming units. The intermediate transfer belt 20 is provided by being wound around a drive roll 22 and the support roll 24 that are in contact with the inner surface of the intermediate transfer belt 20. The intermediate transfer belt 20 travels in a direction from the first image forming unit 10Y to the fourth image forming unit 10K. A force is applied to the support roll 24 in a direction away from the drive roll 22 by a spring or the like (not illustrated), and tension is applied to the intermediate transfer belt 20 wound around both the support roll 24 and the drive roll 22. The intermediate-transfer-belt cleaning device 30 is provided on an image holding surface side of the intermediate transfer belt 20 to face the drive roll 22.

Yellow, magenta, cyan, and black toners contained in toner cartridges 8Y, 8M, 8C, and 8K are supplied to developing devices 4Y, 4M, 4C, and 4K of the image forming units 10Y, 10M, 10C, and 10K, respectively.

The first to fourth image forming units 10Y, 10M, 10C, and 10K have the equivalent configuration and operation. Thus, in a case where the image forming unit is described, the first image forming unit 10Y will be described below as the representative.

The first image forming unit 10Y includes a photoconductor 1Y, a charging roll 2Y, a developing device 4Y, a primary transfer roll 5Y, and a photoconductor cleaning device 6Y. The charging roll 2Y charges the surface of the photoconductor 1Y. The developing device 4Y develops an electrostatic charge image formed on the surface of the photoconductor 1Y, as a toner image, with a developer containing a toner. The primary transfer roll 5Y transfers the toner image formed on the surface of the photoconductor 1Y, to the surface of the intermediate transfer belt 20. The photoconductor cleaning device 6Y removes the toner remaining on the surface of the photoconductor 1Y after the primary transfer.

The charging roll 2Y charges the surface of the photoconductor 1Y. The charging roll 2Y may be a contact charging type or a non-contact charging type.

The charged surface of the photoconductor 1Y is irradiated with a laser beam 3Y from the exposure device 3. Thus, an electrostatic charge image having a yellow image pattern is formed on the surface of the photoconductor 1Y.

In the developing device 4Y, for example, an electrostatic charge image developer containing at least a yellow toner and a carrier is stored. The yellow toner is triboelectrically charged by being agitated in the developing device 4Y. Because the surface of the photoconductor 1Y passes by the developing device 4Y, the electrostatic charge image formed on the photoconductor 1Y is developed as a toner image.

The primary transfer roll 5Y is disposed on the inner side of the intermediate transfer belt 20 and is disposed at a position facing the photoconductor 1Y. A bias power source (not illustrated) for applying a primary transfer bias is connected to the primary transfer roll 5Y. The primary transfer roll 5Y transfers the toner image on the photoconductor 1Y to the intermediate transfer belt 20 by an electrostatic force.

Toner images of the colors are multiplex-transferred on the intermediate transfer belt 20 in order from the first to fourth image forming units 10Y, 10M, 10C, and 10K. The intermediate transfer belt 20 on which the toner images of four colors are multiplex-transferred through the first to fourth image forming units reaches the secondary transfer device configured by the support roll 24 and the secondary transfer roll 26.

The secondary transfer roll 26 is a transfer roll that is in direct contact with the surface of the recording medium, and is disposed at a position facing the support roll 24 on the outside of the intermediate transfer belt 20. The recording paper P (an example of a recording medium) is supplied to the gap where the secondary transfer roll 26 and the intermediate transfer belt 20 are in contact with each other via the supply mechanism. In a case where a secondary transfer bias is applied to the secondary transfer roll 26, an electrostatic force from the intermediate transfer belt 20 toward the recording paper P acts on the toner image, and thus the toner image on the intermediate transfer belt 20 is transferred to the recording paper P.

The recording paper P on which the toner image is transferred is delivered to a nip portion of the fixing device 28 configured by a pair of rolls, and the toner image is fixed on the recording paper P.

The toner and the developer used in the image forming apparatus according to the present exemplary embodiment are not particularly limited, and any known electrophotographic toner and any known developer can be used.

The recording medium used in the image forming apparatus according to the present exemplary embodiment is not particularly limited, and examples of the recording medium include paper used in electrophotographic copying machines and printers; and OHP sheets.

EXAMPLES

Examples will be described below, but the present invention is not limited to the examples. In the following description, unless otherwise specified, "parts" and are all based on the mass.

Example 1

Formation of Elastic Layer

Formation of Elastic Foam

EP70 (urethane foam manufactured by Inoac Corporation) is used as the elastic foam. EP70 is cut into a cylindrical shape having an outer diameter of 26 mm and an inner diameter of 14 mm to obtain a cylindrical elastic foam.

The obtained elastic foam has an open cell structure, a cell diameter of 400 μm, and density of 70 kg/m$^3$.

Formation of Conductive Coating Layer

The elastic foam obtained by the above method is immersed in a treatment liquid at 20° C. for 10 minutes. In the above treatment liquid, an aqueous dispersion in which 36% by mass of carbon black are contained and dispersed, and an acrylic emulsion (manufactured by Nippon Zeon Corporation, product name "Nipol LX852") are mixed at a mass ratio of 1:1.

Then, the elastic foam to which the treatment liquid is attached is heated and dried in a curing furnace set at 100° C. for 60 minutes to remove water and crosslink acrylic resin. A conductive coating layer containing carbon black is formed on the exposed surface of the elastic foam by the acrylic resin cured by crosslinking.

In this manner, an elastic layer configured by the elastic foam and the conductive coating layer that covers the exposed surface of the elastic foam is obtained.

Then, a roll member is formed by inserting a conductive support member (made of SUS, diameter of 14 mm) having a surface to which an adhesive is applied, to the obtained elastic layer.

Formation of Intermediate Layer 70 parts of an urethane oligomer (manufactured by Nippon Synthetic Chemical Co., Ltd., urethane acrylate UV3700B), 30 parts of an urethane monomer (manufactured by Kyoeisha Chemical Co., Ltd., isomiristyl acrylate), 0.5 parts of a polymerization initiator (manufactured by Ciba Specialty Chemicals Co., Ltd., 1-hydroxycyclohexylphenyl ketone Irgacure 184), and 3 parts of alkyltrimethylammonium percolate (product name "LXN-30" manufactured by Daiso Co., Ltd.) are mixed to obtain a coating liquid for forming an intermediate layer. The obtained coating liquid for forming an intermediate layer is applied onto the elastic layer by using a die coater, and the coated film is UV-irradiated for 5 seconds with UV irradiation intensity of 700 mW/cm$^2$ while rotating. With this work, an intermediate layer having a thickness of 1 mm is formed.

Formation of Surface Layer

Subsequently, 5% by mass of a curing agent (WH-1, manufactured by Henkel Japan Ltd.) are added to a urethane resin coating material (EMRALON T-862A, manufactured by Henkel Japan Ltd.), and mixed to obtain a coating liquid for forming a surface layer. The obtained coating liquid for forming a surface layer is applied onto the intermediate layer by spray coating, and the coated film is heated and cured at 120° C. for 20 minutes to form a surface layer having a thickness of 20 μm.

In this manner, a conductive roll having a volume resistance value of $10^{6.8}\Omega$ (measured value in a case where 1000 V is applied) is obtained.

Example 2

A conductive roll is obtained in a manner similar to the manner in Example 1 except that the coating liquid for forming a surface layer is not applied onto the intermediate layer by spray coating, and thus the surface layer is not formed.

Example 3

A conductive roll is obtained in a manner similar to the manner in Example 1 except that the elastic layer and the intermediate layer are formed as follows.

Formation of Elastic Layer

Formation of Elastic Foam 60 parts of EPDM (ethylene-propylene-diene rubber, ESPRENE 505 manufactured by Sumitomo Chemical Co., Ltd.) as a rubber component are kneaded by a pressure kneader. 7 parts of 4,4'-oxybisbenzenesulfonylhydrazide (OBSH) as a chemical foaming agent, 12 parts of acetylene black (manufactured by Denka Company Ltd., DBP oil absorption=212 ml/100 g) as a conductive agent, 23 parts of thermal black (manufactured by Asahi Carbon, DBP oil absorption=103 ml/100 g), 5 parts of zinc oxide (manufactured by NIPPON CHEMICAL INDUSTRIAL CO., LTD.) as a filler, 1.5 parts of a vulcanization accelerator (NOCCELER TS, manufactured by OUCHI SHINKO CHEMICAL INDUSTRIAL CO., LTD.), and 1.5 parts of a vulcanization accelerator (NOCCELER DT, manufactured by OUCHI SHINKO CHEMICAL INDUSTRIAL CO., LTD.) are added and further kneaded with two heating rolls. The mixture is inserted into a SUS core metal (14 mmφ) and foam-molded into a roll to form a roll member.

Formation of Conductive Coating Layer

The elastic foam obtained by the above method is immersed in a treatment liquid at 20° C. for 10 minutes. In the above treatment liquid, an aqueous dispersion in which 36% by mass of carbon black are contained and dispersed, and an acrylic emulsion (manufactured by Nippon Zeon Corporation, product name "Nipol LX852") are mixed at a mass ratio of 1:1.

Then, the elastic foam to which the treatment liquid is attached is heated and dried in a curing furnace set at 100° C. for 60 minutes to remove water and crosslink acrylic resin. A conductive coating layer containing carbon black is formed on the exposed surface of the elastic foam by the acrylic resin cured by crosslinking.

In this manner, an elastic layer configured by the elastic foam and the conductive coating layer that covers the exposed surface of the elastic foam is obtained.

Formation of Intermediate Layer 60 parts of EPDM (ethylene-propylene-diene rubber, ESPRENE 505 manufactured by Sumitomo Chemical Co., Ltd.) as a rubber component are kneaded by a pressure kneader. 12 parts of acetylene black (manufactured by Denka Company Ltd., dibutyl phthalate (DBP) oil absorption=212 ml/100 g) as a conductive agent, 23 parts of thermal black (manufactured by Asahi Carbon Co., Ltd., DBP oil absorption=103 ml/100 g), 5 parts of zinc oxide (manufactured by NIPPON CHEMICAL INDUSTRIAL CO., LTD.) as a filler, 1 part of stearic acid, 1.5 parts of a vulcanization accelerator (NOCCELER TS, manufactured by OUCHI SHINKO CHEMICAL INDUSTRIAL CO., LTD.), and 1.5 parts of a vulcanization accelerator (NOCCELER DT, manufactured by OUCHI SHINKO CHEMICAL INDUSTRIAL CO., LTD.) are added and further kneaded with two heating rolls. The obtained composite is extruded into a tube shape to cover the elastic layer. In this manner, a coating roll is formed.

The obtained coating roll is heated in a vulcanization furnace and the surface is polished by cylindrical polishing. In this manner, an intermediate layer having a thickness of 1 mm is formed.

Comparative Example 1

A conductive roll is obtained in a manner similar to the manner in Example 1 except that the intermediate layer and the surface layer are not formed.

Comparative Example 2

The elastic layer is formed in a procedure similar to the procedure in Example 1 except that EP70 (manufactured by Inoac Corporation) is used to form the elastic foam, and EP70 is cut into a cylindrical shape having an outer diameter of 28 mm and an inner diameter of 14 mm to obtain a cylindrical elastic foam. Then, the coating liquid for forming a surface layer, which is prepared in Example 1, is applied onto the elastic layer by spray coating, and the coated film is cured by heating at 120° C. for 20 minutes to form a top layer having a thickness of 20 μm. In this manner, a conductive roll is obtained.

Comparative Example 3 and Example 4

A conductive roll is obtained in a manner similar to the manner in Example 1 except that the thickness of the intermediate layer is set as shown in Table 1 in the formation of the intermediate layer.

Example 5

A conductive roll is obtained in a manner similar to the manner in Example 1 except that, in the formation of the surface layer, 5% by mass of a curing agent (WH-1, manufactured by Henkel Japan Ltd.) are added to a urethane resin coating material (EMRALON T-845A, manufactured by Henkel Japan Ltd.), and mixed to obtain a coating liquid for forming a surface layer.

Example 6

A conductive roll is obtained in a manner similar to the manner in Example 1 except that, in the formation of the surface layer, 3 parts by mass (Example 6) of a curing agent (WH-1, manufactured by Henkel Japan Ltd.) are added to a urethane resin coating material (EMRALON T-845A, manufactured by Henkel Japan Ltd.), and mixed to obtain a coating liquid for forming a surface layer.

Example 7

A conductive roll is obtained in a manner similar to the manner in Example 1 except that the conductive coating layer is not formed.

Example 8

A conductive roll is obtained in a manner similar to the manner in Example 1 except that A-8 (PE) (polyethylene foam manufactured by Inoac Corporation) is used as an elastic foam instead of EP70, in the formation of the elastic foam, and the conductive coating layer is not formed.

Example 9

A conductive roll is obtained in a manner similar to the manner in Example 1 except that RR26 (urethane foam manufactured by Inoac Corporation) is used as an elastic foam instead of EP70, in the formation of the elastic foam.

Example 10

A conductive roll is obtained in a manner similar to the manner in Example 1 except that RMM (urethane foam manufactured by Inoac Corporation) is used as an elastic foam instead of EP70, in the formation of the elastic foam.

Example 11

A conductive roll is obtained in a manner similar to the manner in Example 1 except that RR90 (urethane foam manufactured by Inoac Corporation, foaming grade lower than EP70) is used as an elastic foam instead of EP70, in the formation of the elastic foam.

Example 12

A conductive roll is obtained in a manner similar to the manner in Example 1 except that RR90 (urethane foam manufactured by Inoac Corporation) is used as an elastic foam instead of EP70, in the formation of the elastic foam.

Example 13

A conductive roll is obtained in a manner similar to the manner in Example 1 except that the surface layer is formed as follows.

A coating liquid for forming a surface layer, which has a composition identical to the composition of the coating liquid for forming an intermediate layer is obtained in a manner similar to the procedure for producing the coating liquid for forming an intermediate layer. The obtained coating liquid for forming a surface layer is applied onto the elastic layer by using a die coater, and the coated film is UV-irradiated for 30 seconds with UV irradiation intensity of 700 mW/cm$^2$ while rotating. With this work, a surface layer having a thickness of 0.02 mm is formed.

Example 14

A conductive roll is obtained in a manner similar to the manner in Example 1 except that the UV irradiation intensity is set to 550 mW/cm$^2$ in the formation of the intermediate layer.

Example 15

A conductive roll is obtained in a manner similar to the manner in Example 12 except that the surface layer is formed as follows.

A coating liquid for forming a surface layer, which has a composition identical to the composition of the coating liquid for forming an intermediate layer is obtained in a manner similar to the procedure for producing the coating liquid for forming an intermediate layer. The obtained coating liquid for forming a surface layer is applied onto the elastic layer by using a die coater, and the coated film is UV-irradiated for 5 seconds with UV irradiation intensity of 450 mW/cm$^2$ while rotating. With this work, a surface layer having a thickness of 0.02 mm is formed.

Example 16

A conductive roll is obtained in a manner similar to the manner in Example 12 except that the surface layer is formed as follows.

A coating liquid for forming a surface layer, which has a composition identical to the composition of the coating liquid for forming an intermediate layer is obtained in a manner similar to the procedure for producing the coating liquid for forming an intermediate layer. The obtained coating liquid for forming a surface layer is applied onto the elastic layer by using a die coater, and the coating film is UV-irradiated for 5 seconds with UV irradiation intensity of 500 mW/cm$^2$ while rotating. With this work, a surface layer having a thickness of 0.02 mm is formed.

Example 17

A conductive roll is obtained in a manner similar to the manner in Example 1 except that the urethane resin coating material (EMRALON T-862A, manufactured by Henkel Japan Ltd.) is changed to a urethane dispersion UW-5002E (manufactured by Ube Industries, Ltd.) in the formation of the surface layer.

Example 18

A conductive roll is obtained in a manner similar to the manner in Example 1 except that the urethane resin coating material (EMRALON T-862A, manufactured by Henkel Japan Ltd.) is changed to a urethane dispersion UW-5502 (manufactured by Ube Industries, Ltd.) in the formation of the surface layer.

Example 19

A conductive roll is obtained in a manner similar to the manner in Example 12 except that the UV irradiation intensity is set to 420 mW/cm$^2$ in the formation of the intermediate layer.

Example 20

A conductive roll is obtained in a manner similar to the manner in Example 12 except that the UV irradiation intensity is set to 430 mW/cm$^2$ in the formation of the intermediate layer.

Example 21

A conductive roll is obtained in a manner similar to the manner in Example 1 except that the amount of an urethane oligomer (manufactured by Nippon Synthetic Chemical Co., Ltd., urethane acrylate UV3700B) to be added in a case where the coating liquid for forming an intermediate layer is obtained is set to 90 parts, and the UV irradiation time is set to 20 seconds, in the formation of the intermediate layer.

Example 22

A conductive roll is obtained in a manner similar to the manner in Example 1 except that the amount of an urethane oligomer (manufactured by Nippon Synthetic Chemical Co., Ltd., urethane acrylate UV3700B) to be added in a case where the coating liquid for forming an intermediate layer is obtained is set to 90 parts, and the UV irradiation time is set to 30 seconds, in the formation of the intermediate layer.

Examples 23 to 26

Conductive rolls are obtained in a manner similar to the manner in Example 1 except that the coating liquid for forming a surface layer is not applied onto the intermediate layer by spray coating, and the surface layer is not formed, and the thickness (corresponding to the "thickness Ts of the top layer" because the top layer is a single layer in Examples 23 to 26) of the intermediate layer in the formation of the intermediate layer is set as shown in Table 1.

Examples 27 to 30

Conductive rolls are obtained in a manner similar to the manner in Example 1 except that the thickness of the intermediate layer is set as shown in Table 1.

Evaluation

Parallelism of Image Transferred to Recording Medium

Using ApeosPort VII C6688 (manufactured by Fuji Xerox) in which the conductive roll in each example is incorporated as the secondary transfer roll, the pushing amount onto the intermediate transfer belt facing the secondary transfer roll is set to Rear 0.2 mm and Front 0.8 mm, and a difference "(Rear)-(Front)" in the pushing amount of Rear and Front onto the intermediate transfer belt is set to 0.6 mm. In this manner, the secondary transfer roll is installed. A rectangular line of 280 mm×400 mm is formed on the intermediate transfer belt, transferred to paper having the A3 size by a secondary transfer unit, and fixed by the fixing device. Then, an image line length ($L_{Rear}$, $L_{Front}$) on the Rear side and the Front side of an output image is measured, and an image length difference ($L_{Front}$)−($L_{Rear}$) is calculated, and thus the parallelism ΔL is calculated (see FIG. 1B). Evaluation is performed based on the calculated parallelism ΔL in accordance with evaluation criteria as follows.

Evaluation Criteria

A (○): $\Delta L \geq 1.5$ mm

B (Δ): 0.5 mm$\leq \Delta L <$1.5 mm

C (x): 0.5 mm$>\Delta L$

TABLE 1-1

| | Elastic layer | | | | | | | Single top layer | | | Top layer having multiple layers | | | | | | Conductive roll | | | Evaluation |
|---|---|---|---|---|---|---|---|---|---|---|---|---|---|---|---|---|---|---|---|---|
| | Elastic foam | | | Whether to provide | | Top layer | | | | | Intermediate layer | | | Surface layer | | | | | | |
| | Type of elastic material | Whether to have open cell structure | Density (kg/M$^3$) | conductive coating layer | Young modulus Yd [Mpa] | Layer structure | Friction coefficient | Type of binder material | Young modulus Ys [Mpa] | Thickness Ts (mm) | Type of binder material | Young modulus Ym [Mpa] | Thickness Tm (mm) | Type of binder material | Young modulus [Mpa] | Thickness (mm) | Shrinkage rate (%) | Ratio of Young modulus Ys/Yd | Ratio of Young modulus Ym/Yd | Paralelism of image |
| Example 1 | EP70 | Provided | 70 | Provided | 0.10 | Multiple layers | 0.42 | — | — | — | Urethane resin | 8 | 1.0 | Urethane resin | 150 | 0.02 | 7.5 | — | 80 | A(o) |
| Example 2 | EP70 | Provided | 70 | Provided | 0.10 | Single layer | 0.70 | Urethane resin | 8 | 1.00 | — | — | — | — | — | — | 8.0 | 80 | — | A(o) |
| Example 3 | EPDM | Provided | 65 | Provided | 0.15 | Multiple layers | 0.70 | — | — | — | EPDM | 9 | 1.0 | Urethane resin | 150 | 0.02 | 7.3 | — | 60 | A(o) |
| Comparative example 1 | EP70 | Provided | 70 | Provided | 0.10 | — | 0.10* | — | — | — | — | — | — | — | — | — | 9.5 | — | — | C(*) |
| Comparative example 2 | EP70 | Provided | 70 | Provided | 0.10 | Single layer | 0.42 | Urethane resin | 150 | 0.02 | — | — | — | — | — | — | 3.7 | 1500 | — | C(*) |
| Comparative example 3 | EP70 | Provided | 70 | Provided | 0.10 | Multiple layers | 0.42 | — | — | — | Urethane resin | 8 | 0.2 | Urethane resin | 150 | 0.02 | 4.0 | — | 80 | C(*) |
| Example 4 | EP70 | Provided | 70 | Provided | 0.10 | Multiple layers | 0.42 | — | — | — | Urethane resin | 8 | 0.5 | Urethane resin | 150 | 0.02 | 5.0 | — | 80<br>80 | B(Δ)<br>B(Δ) |
| Example 5 | EP70 | Provided | 70 | Provided | 0.10 | Multiple layers | 0.10 | — | — | — | Urethane resin | 8 | 1.0 | Urethane resin | 300 | 0.02 | 6.0 | — | 80 | B(Δ) |
| Example 6 | EP70 | Provided | 70 | Provided | 0.10 | Multiple layers | 0.20 | — | — | — | Urethane resin | 8 | 1.0 | Urethane resin | 250 | 0.02 | 8.0 | — | 80 | A(o) |
| Example 7 | EP70 | Provided | 70 | None | 0.10 | Multiple layers | 0.42 | — | — | — | Urethane resin | 8 | 1.0 | Urethane resin | 150 | 0.02 | 8.1 | — | 80 | B(Δ) |
| Example 8 | A-8 (PE) | None | 64 | None (kneading) | 0.09 | Multiple layers | 0.42 | — | — | — | Urethane resin | 8 | 1.0 | Urethane resin | 150 | 0.02 | 5.0 | — | 89 | B(Δ) |
| Example 9 | RR26 | Provided | 35 | Provided | 0.05 | Multiple layers | 0.42 | — | — | — | Urethane resin | 8 | 1.0 | Urethane resin | 150 | 0.02 | 6.0 | — | 160 | B(Δ) |
| Example 10 | RMM | Provided | 55 | Provided | 0.07 | Multiple layers | 0.42 | — | — | — | Urethane resin | 8 | 1.0 | Urethane resin | 150 | 0.02 | 7.8 | — | 114 | A(o) |
| Example 11 | RR90 | Provided | 85 | Provided | 0.25 | Multiple layers | 0.42 | — | — | — | Urethane resin | 8 | 1.0 | Urethane resin | 150 | 0.02 | 8.1 | — | 32 | A(o) |
| Example 12 | RR90 | Provided | 90 | Provided | 0.30 | Multiple layers | 0.42 | — | — | — | Urethane resin | 8 | 1.0 | Urethane resin | 150 | 0.02 | 7.5 | — | 27 | B(Δ) |

TABLE 1-2

| | Elastic Layer | | | | | | | Single top later | | | Top layer having multiple layers | | | | | | Conductive roll | | | Evaluation |
|---|---|---|---|---|---|---|---|---|---|---|---|---|---|---|---|---|---|---|---|---|
| | Elastic foam | | | Whether to provide | | Top layer | | | | | Intermediate layer | | | Surface layer | | | | | | |
| | Type of elastic material | Whether to have open cell structure | Density (kg/M$^3$) | conductive coating layer | Young modulus Yd [Mpa] | Layer structure | binder material | Type of binder material | Young modulus Ys [Mpa] | Thickness Ts (mm) | Type of binder material | Young modulus Ym [Mpa] | Thickness Tm (mm) | Type of binder material | Young modulus [Mpa] | Thickness (mm) | Shrinkage rate (%) | Ratio of Young modulus Ys/Yd | Ratio of Young modulus Ym/Yd | Parallelism of image |
| Example 13 | EP70 | Provided | 70 | Provided | 0.10 | Multiple layers | 0.60 | — | — | — | Urethane resin | 8 | 1.0 | Urethane resin | 10 | 0.02 | 6.4 | — | 80 | A(o) |
| Example 14 | EP70 | Provided | 70 | Provided | 0.10 | Multiple layers | 0.42 | — | — | — | Urethane resin | 4 | 1.0 | Urethane resin | 150 | 0.02 | 6.0 | — | 40 | B(Δ) |
| Example 15 | RR90 | Provided | 90 | Provided | 0 .30 | Multiple layers | 0.42 | — | — | — | Urethane resin | 8 | 1.0 | Urethane resin | 2.5 | 0.02 | 5.0 | — | 27 | B(Δ) |
| Example 16 | RR90 | Provided | 90 | Provided | 0.30 | Multiple layers | 0.42 | — | — | — | Urethane resin | 8 | 1.0 | Urethane resin | 3 | 0.02 | 5.1 | — | 27 | |
| Example 17 | EP70 | Provided | 70 | Provided | 0.10 | Multiple layers | 0.42 | — | — | — | Urethane resin | 8 | 1.0 | Urethane resin | 620 | 0.02 | 5.0 | — | 80 | A(o) |
| Example 18 | EP70 | Provided | 70 | Provided | 0.10 | Multiple layers | 0.42 | — | — | — | Urethane resin | 8 | 1.0 | Urethane resin | 1200 | 0.02 | 5.4 | — | 80 | B(Δ) |
| Example 19 | RR90 | Provided | 90 | Provided | 0.30 | Multiple layers | 0.42 | — | — | — | Urethane resin | 2 | 1.0 | Urethane resin | 150 | 0.02 | 6.2 | — | 7 | B(Δ) |
| Example 20 | RR90 | Provided | 90 | Provided | 0.30 | Multiple layers | 0.42 | — | — | — | Urethane resin | 3 | 1.0 | Urethane resin | 150 | 0.02 | 6.8 | — | 10 | A(o) |
| Example 21 | E870 | Provided | 70 | Provided | 0.10 | Multiple layers | 0.42 | — | — | — | Urethane resin | 80 | 1.0 | Urethane resin | 150 | 0.02 | 5.5 | — | 800 | A(0) |
| Example 22 | EP 70 | Provided | 70 | Provided | 0.10 | Multiple layers | 0.42 | — | — | — | Urethane resin | 100 | 1.0 | Urethane resin | 150 | 0.02 | 6.0 | — | 1000 | B(Δ) |
| Example 23 | EP70 | Provided | 70 | Provided | 0.10 | Single layer | 0.65 | Urethane resin | 8 | 0.40 | — | — | — | — | — | — | 5.2 | 80 | — | B(Δ) |
| Example 24 | EP70 | Provided | 70 | Provided | 0.10 | Single layer | 0.65 | Urethane resin | 8 | 0.50 | — | — | — | — | — | — | 6.8 | 80 | — | A(o) |
| Example 25 | EP 70 | Provided | 70 | Provided | 0.10 | Single layer | 0.65 | Urethane resin | 8 | 5.00 | — | — | — | — | — | — | 6.4 | 80 | — | A(o) |
| Example 26 | EP 70 | Provided | 70 | Provided | 0.10 | Single layer | 0.65 | Urethane resin | 8 | 5.10 | — | — | — | — | — | — | 5.1 | 80 | — | B(Δ) |
| Example 27 | EP 70 | Provided | 70 | Provided | 0.10 | Multiple layers | 0.42 | — | — | — | Urethane resin | 8 | 0.4 | Urethane resin | 150 | 0.02 | 5.0 | — | 80 | B(Δ) |
| Example 28 | EP 70 | Provided | 70 | Provided | 0.10 | Multiple layers | 0.42 | — | — | — | Urethane resin | 8 | 0.5 | Urethane resin | 150 | 0.02 | 6.5 | — | 80 | A(o) |
| Example 29 | EP 70 | Provided | 70 | Provided | 0.10 | Multiple layers | 0.42 | — | — | — | Urethane resin | 8 | 5.0 | Urethane resin | 150 | 0.02 | 6.2 | — | 80 | A(o) |
| Example 30 | EP 70 | Provided | 70 | Provided | 0.10 | Multiple layers | 0.42 | — | — | — | Urethane resin | 8 | 5.1 | Urethane resin | 150 | 0.02 | 5.0 | — | 80 | B(Δ) |

The friction coefficient of the conductive roll in Comparative Example 1, which is shown in Table 1 is a result obtained by measuring the friction coefficient of the outer peripheral surface of the elastic layer. The measurement is performed in a manner similar to the measurement of the friction coefficient of the outer peripheral surface of the top layer.

From the above results, it can be understood that the conductive rolls in the examples easily increase the parallelism of an image transferred to a recording medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive roll comprising:

a support member;

an elastic layer disposed on an outer peripheral surface of the support member; and a top layer disposed on an outer peripheral surface of the elastic layer, wherein, in a case where a pushing amount of a metal roll into the conductive roll is 1.7%, the metal roll having an outer diameter identical to an outer diameter of the conductive roll, a shrinkage rate of a surface of the conductive roll with respect to the outer diameter of the conductive roll is equal to or more than 5%.

2. The conductive roll according to claim 1, wherein a friction coefficient of an outer peripheral surface of the top layer is equal to or more than 0.2.

3. The conductive roll according to claim 1, wherein the elastic layer is configured to include a cylindrical elastic foam and a conductive coating layer that covers an exposed surface of the elastic foam.

4. The conductive roll according to claim 2, wherein the elastic layer is configured to include a cylindrical elastic foam and a conductive coating layer that covers an exposed surface of the elastic foam.

5. The conductive roll according to claim 3, wherein the elastic foam has an open cell structure.

6. The conductive roll according to claim 4, wherein the elastic foam has an open cell structure.

7. The conductive roll according to claim 5, wherein density of the elastic foam is equal to or more than 50 $Kg/m^3$ and equal to or less than 90 $Kg/m^3$.

8. The conductive roll according to claim 6, wherein density of the elastic foam is equal to or more than 50 $Kg/m^3$ and equal to or less than 90 $Kg/m^3$.

9. The conductive roll according to claim 1, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

10. The conductive roll according to claim 2, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

11. The conductive roll according to claim 3, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

12. The conductive roll according to claim 4, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

13. The conductive roll according to claim 5, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

14. The conductive roll according to claim 6, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

15. The conductive roll according to claim 7, wherein, in a case where the top layer is a single layer, a Young's modulus Yd of the elastic layer and a Young's modulus Ys of the top layer satisfy the following expression (1-1), and in a case where the top layer is configured by a plurality of layers, the top layer includes an intermediate layer disposed on the outer peripheral surface of the elastic layer and a surface layer disposed on an outer peripheral surface of the intermediate layer, and the Young's modulus Yd of the elastic layer and a Young's modulus Ym of the intermediate layer satisfy the following expression (2-1)

$Yd<Ys$ Expression (1-1):

$Yd<Ym$ Expression (2-1).

16. The conductive roll according to claim 9, wherein the Young's modulus Yd and the Young's modulus Ys satisfy the following expression (1-2), and the Young's modulus Yd and the Young's modulus Ym satisfy the following expression (2-2)

$10 \leq Ys/Yd \leq 10000$ Expression (1-2):

$10 \leq Ym/Yd \leq 1000$ Expression (2-2).

17. The conductive roll according to claim 1, wherein a thickness Ts of the top layer in a case where the top layer is a single layer and a thickness Tm of the intermediate layer in a case where the top layer is configured by a plurality of layers are equal to or more than 0.5 mm and equal to or less than 5 mm.

18. A transfer device comprising:

the conductive roll according to claim 1.

19. A process cartridge attachable to and detachable from an image forming apparatus, the process cartridge comprising:

an image holding member; and the transfer device according to claim 18.

20. An image forming apparatus comprising:

an image holding member;

a charging device that charges a surface of the image holding member;

an electrostatic charge image forming device that forms an electrostatic charge image on the charged surface of the image holding member;

a developing device that develops the electrostatic charge image formed on the surface of the image holding member as a toner image with a developer containing a toner; and the transfer device according to claim 18, that transfers the toner image to a surface of a recording medium.

* * * * *